US006500018B1

(12) United States Patent
Pfaffenberger et al.

(10) Patent No.: US 6,500,018 B1
(45) Date of Patent: Dec. 31, 2002

(54) PRINTED CIRCUIT BOARD RETAINER

(75) Inventors: David S. Pfaffenberger, Mishawaka, IN (US); Markus C. Carrison, Goshen, IN (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 09/944,513

(22) Filed: Aug. 31, 2001

(51) Int. Cl.[7] ..... H01R 13/62; H01R 13/64
(52) U.S. Cl. ..... 439/325; 439/327; 439/374
(58) Field of Search ..... 439/325, 326, 439/327, 153, 157, 374, 377

(56) References Cited

U.S. PATENT DOCUMENTS

| | | | | |
|---|---|---|---|---|
| 5,145,396 A | | 9/1992 | Yeung | 439/326 |
| 5,234,354 A | | 8/1993 | Smart | 439/326 |
| 5,387,115 A | | 2/1995 | Kozel | 439/157 |
| 5,499,162 A | * | 3/1996 | Bartuska et al. | 235/486 |
| 5,516,304 A | * | 5/1996 | Yu | 439/326 |
| 5,660,557 A | * | 8/1997 | Lemke et al. | 439/328 |
| 5,944,549 A | | 8/1999 | Po | 439/326 |
| 6,056,579 A | * | 5/2000 | Richards et al. | 439/327 |
| 6,062,893 A | * | 5/2000 | Miskin et al. | 439/374 |

OTHER PUBLICATIONS

Web Page Logitech i gel mouse URL:http://www.logitech-.com/cf/products/productfeatures.cfm/79.

* cited by examiner

*Primary Examiner*—Lynn Field
*Assistant Examiner*—Chandrika Prasad
(74) *Attorney, Agent, or Firm*—Mark P. Bourgeois

(57) ABSTRACT

A printed circuit board retainer for holding a printed circuit board. The printed circuit board retainer includes a plate having opposing surfaces. Several slots extend through the plate. A latch assembly extends from another surface. The latch assembly has the printed circuit board mounted to it. Several terminals are mounted to the printed circuit board and extend through the slots. A lock is mounted to the latch assembly to prevent the latch assembly from releasing.

13 Claims, 4 Drawing Sheets

PRINTED CIRCUIT BOARD RETAINER

BACKGROUND OF THE INVENTION

1. Field of the Invention

This invention relates to a printed circuit board holder and connector assembly.

2. Description of the Related Art

Electronic enclosures are typically formed with an area to attach a connector to obtain certain signals. A wire harness may be connected to an electronic enclosure. The enclosure has a connector shroud that mates with a part on the wire harness. The connector contains metal terminals that typically have a male portion and a female portion that mate together to form an electrical path.

The prior art electronic enclosures have been made by insert molding. In insert molding, the metal terminals are placed into a plastic injection mold cavity and liquid plastic is injected at high pressure into the cavity around the metal terminals and cooled to form the finished part. This provides a very secure attachment between the terminals and the enclosure or housing. Unfortunately, insert molding has many associated problems. For example, insert molding is more expensive than non-insert molding because additional labor is required to place the metal terminals in the mold prior to injecting the plastic. Longer cycles times are necessary for insert molding resulting in lower production for a given machine.

The injection of the plastic around the inserts can cause them to shift resulting in a defective part. Further the shifting of the inserts can also cause damage to the mold.

Connecting a printed circuit board to insert molded terminals is difficult because there is limited access to the ends of the terminals in a typical molded housing. One solution is to use wire bonding to run a wire between the printed circuit board and the terminals. Unfortunately, this adds additional cost to the process.

There is a current unmet need for an printed circuit board mounting system for connection with terminals in an enclosure that can be produced at a low cost and that is reliable.

SUMMARY OF THE INVENTION

It is a feature of the present invention to provide a printed circuit board retainer. The printed circuit board retainer includes a plate having opposing first and second surfaces. Several slots extend through the plate. A latch assembly extends from the second surface. The latch assembly has the printed circuit board mounted to it. Several terminals are mounted to the printed circuit board and extend through the slots. A lock is mounted to the latch assembly to prevent the latch assembly from releasing.

Figure 1:
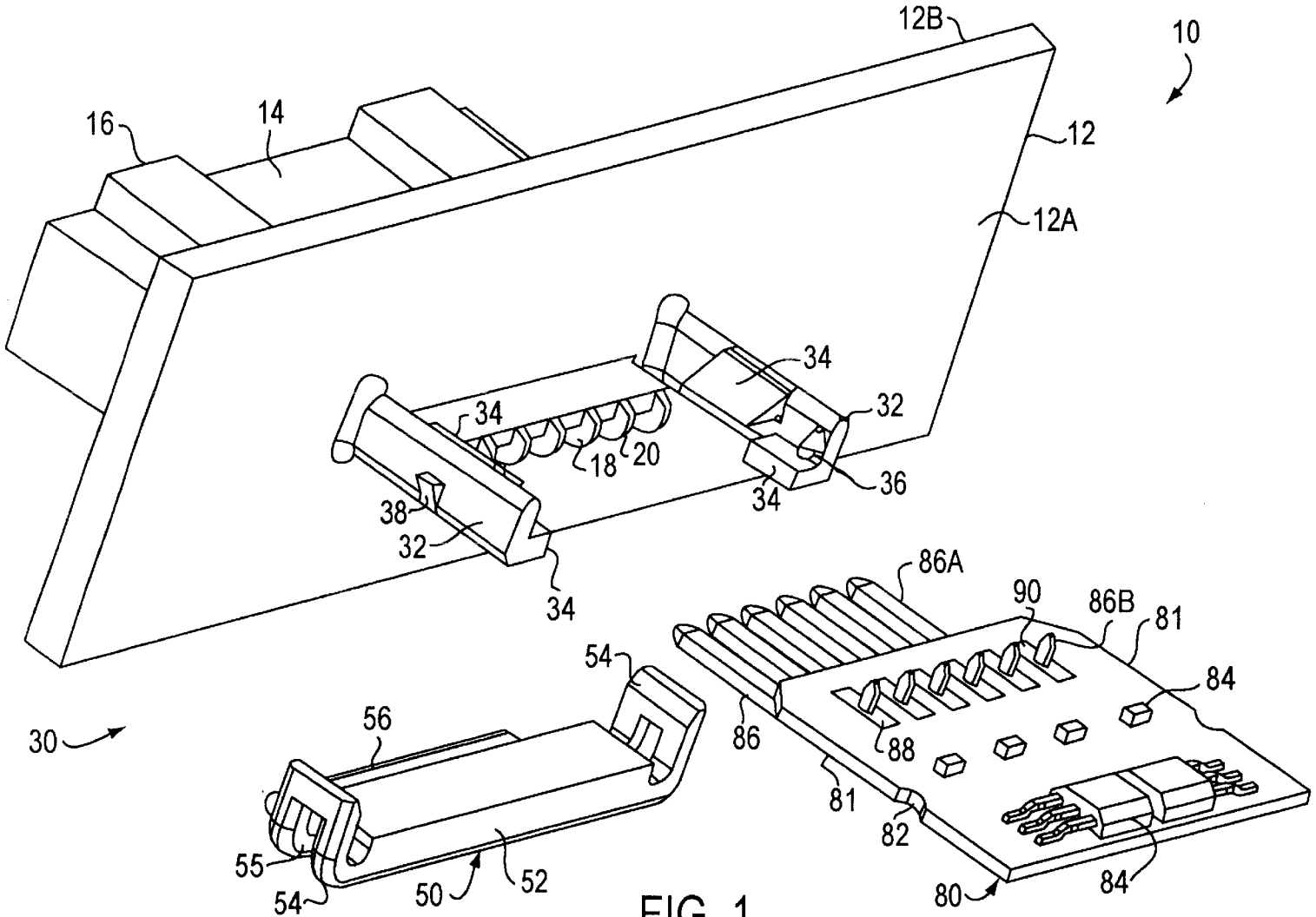
FIG. 1 is a perspective exploded view of the preferred embodiment of a printed circuit board retainer.
Figure 2:
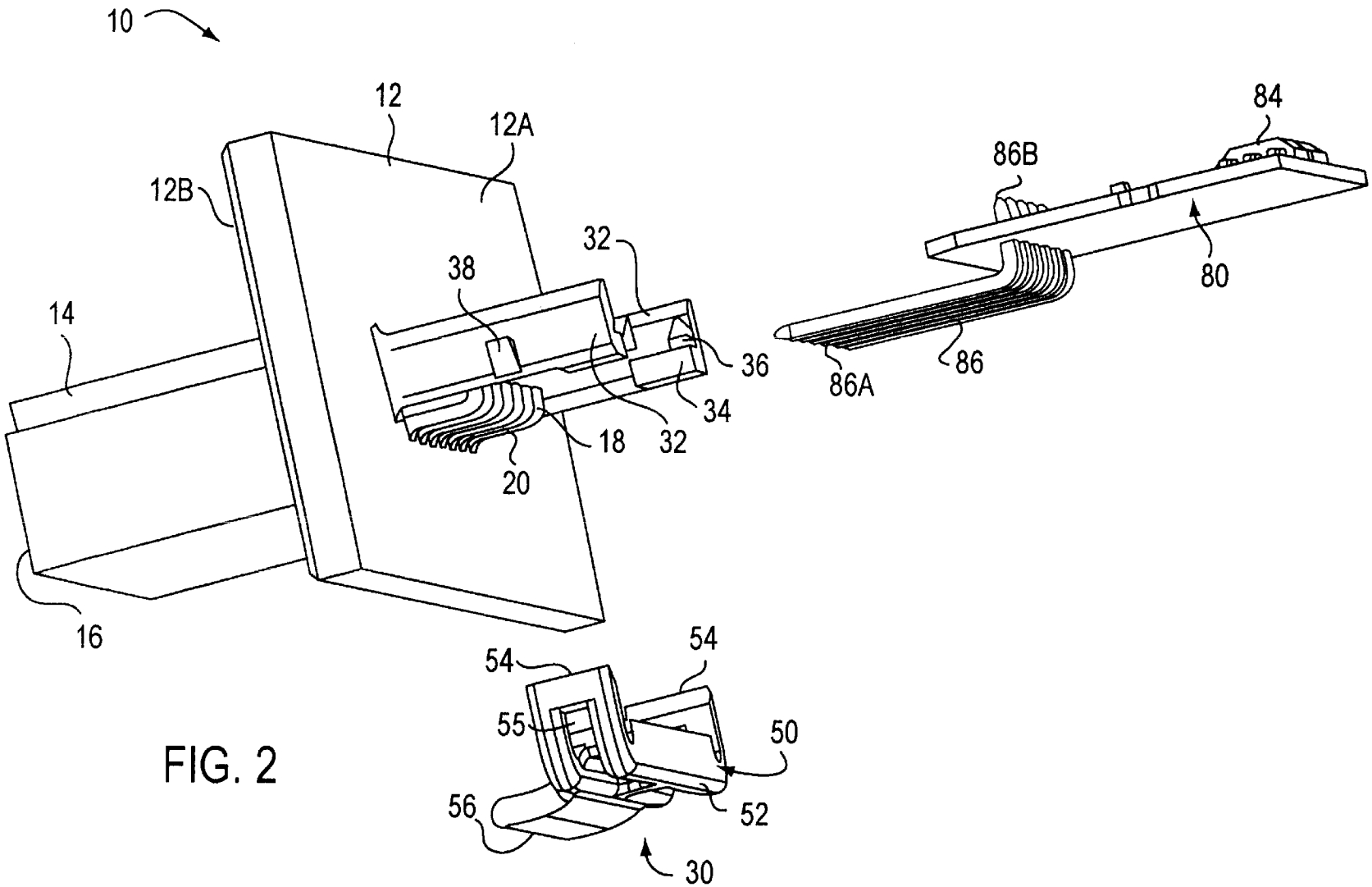
FIG. 2 is another perspective exploded view of a printed circuit board retainer.

It is noted that the drawings of the invention are not to scale.

DETAILED DESCRIPTION OF THE PREFERRED EMBODIMENTS

Printed Circuit Board Retainer

The present invention is a printed circuit board retainer. Referring to FIGS. 1–4 there is a printed circuit board retainer assembly 10 shown. Assembly 10 has a plate 12 with surfaces 12A and 12B. A connector shroud 14 extends from surface 12B. Shroud 14 has a cavity 16 therein. A female connector portion (not shown) would mate with shroud 14. Several insulative walls 20 extend from surface 12A. Walls 20 define slots 18 between walls 20. The slots 18 extend all the way through plate 12.

A latch assembly 30 is mounted between plate 12 and a printed circuit board 80. Latch assembly 30 has a pair of rails 32 extending from surface 12B. Rails 32 each have a pair of tabs 34. Tabs 34 guide and hold printed circuit board 80. A protrusion 36 is located on the inside end of each rail 32. Rails 32 also have a bump 38 located on the outside middle of rail 32. A lock 50 is mounted to latch assembly 30 to prevent the latch assembly from releasing the printed circuit board 80 from rails 32. Lock 50 has a beam 52. A pair of fingers 54 extend from each end of beam 52. A hole 55 is located in each finger 54. A lip 56 extends along one side of beam 52. Lip 56 is designed to extend over walls 20 to cover terminals 86 after lock 50 is installed. Lip 56 supports the terminals especially during mating with a connector to prevent the terminals from being forced out of position or to prevent overstressing the terminal to conductor pad solder joint.

Printed circuit board 80 has a pair of notches 82 and several electronic components 84 mounted to board 80. The electronic components can be almost any electronic component such as transistors, hall-effect devices, filters, resistors, capacitors, integrated circuits. Several terminals 86 are mounted to printed circuit board 80. Terminals 86 have an end 86A and a curved end 86B. Curved end 86B extends through a hole 88. Curved end 88B would be soldered to a conductor pad 90 on printed circuit board 80. Terminal end 86A slides through slots 18 into cavity 16. Walls 20 guide and support terminals 86 as they are inserted and also serve to insulate the terminals from each other.

Figure 3:
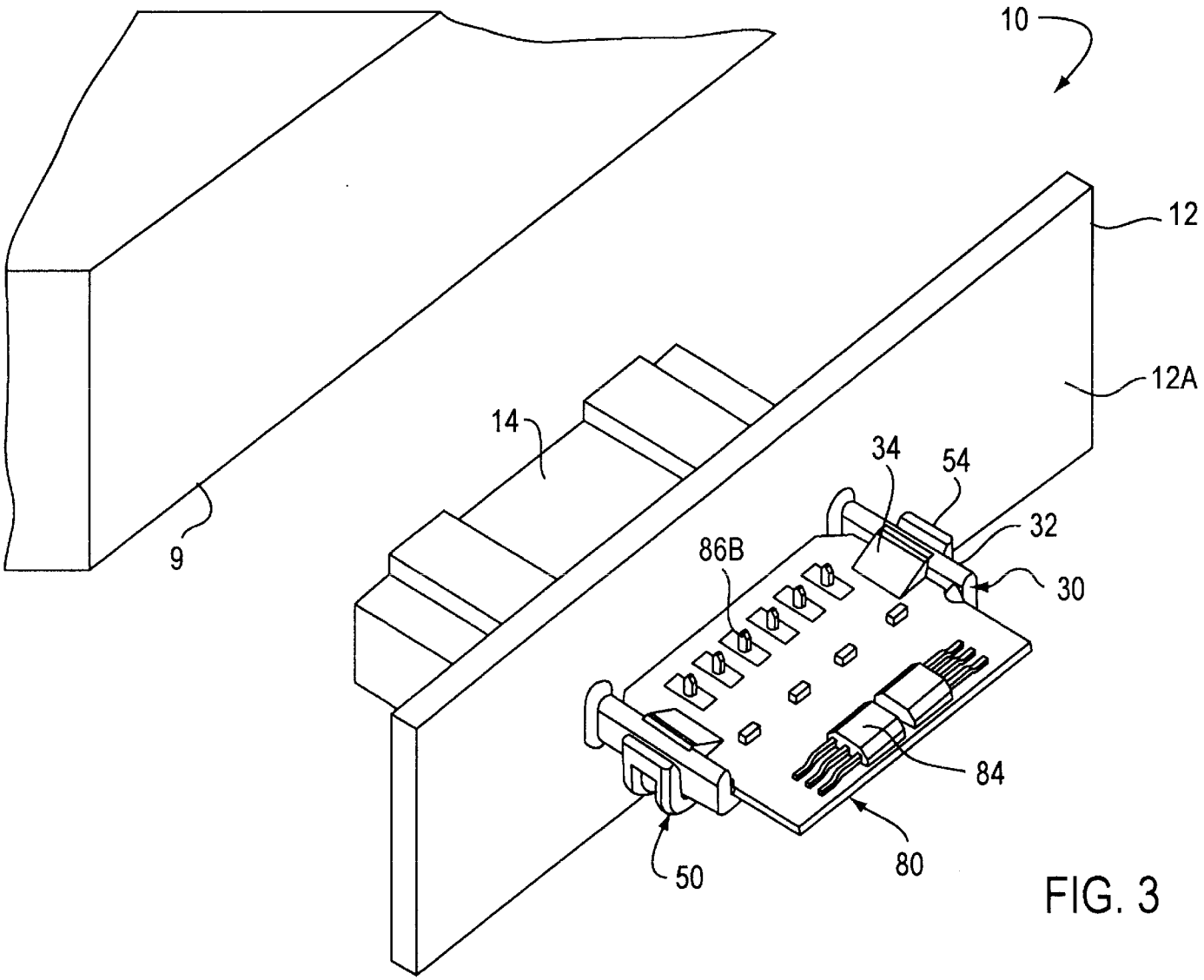
FIG. 3 is a perspective assembled view of FIG. 1.
Figure 4:
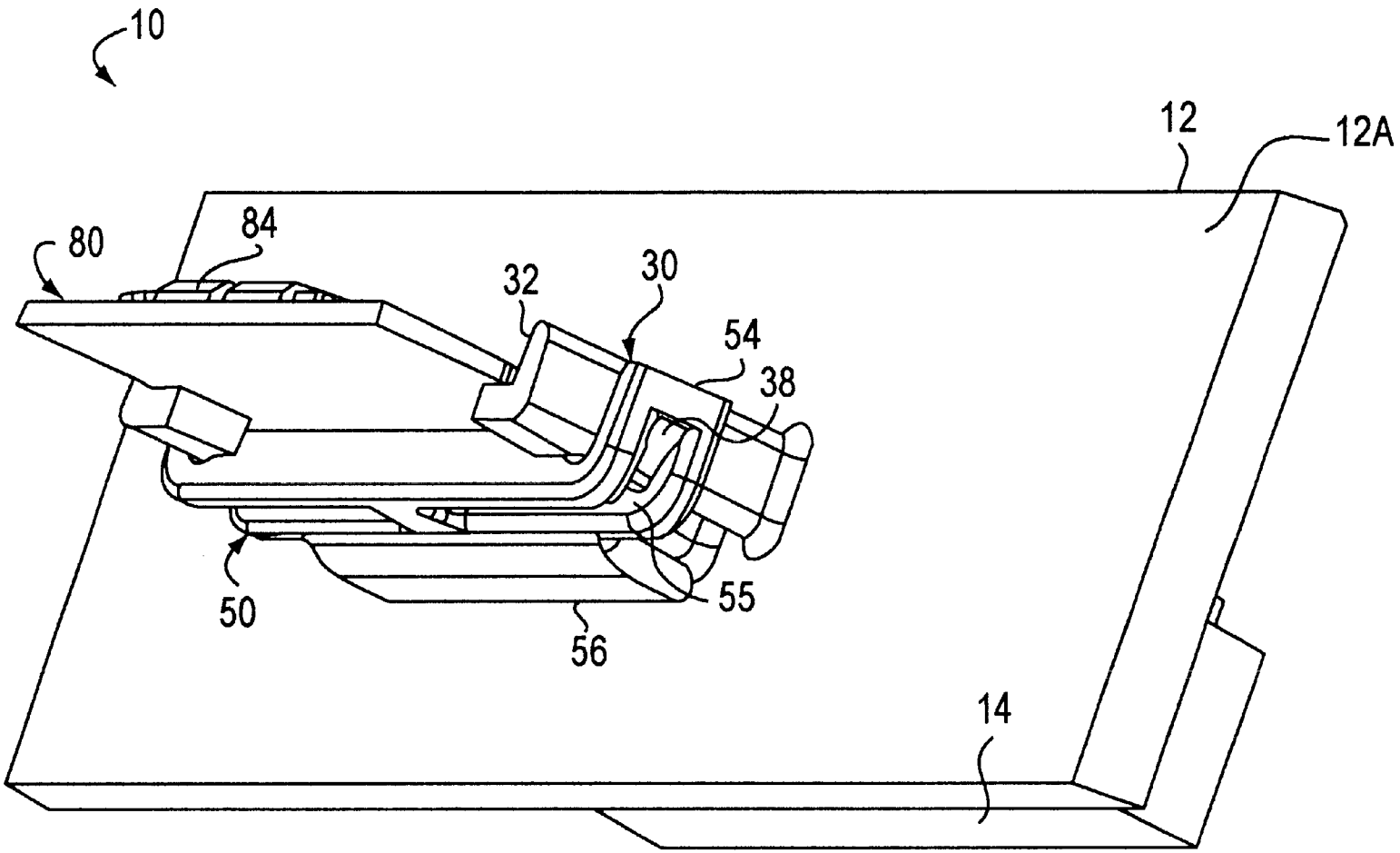
FIG. 4 is a perspective assembled view of FIG. 2.

Printed circuit board retainer assembly 10 is preferably heat staked as a cover or lid to a larger enclosure or housing 9 (FIG. 3). The enclosure would seal the printed circuit board and electronic components from environmental exposure.

Assembly

The printed circuit board retainer assembly 10 is assembled as follows: Terminals 86 are soldered to printed circuit board 80. Printed circuit board 80 is slid toward plate 12. Terminal ends 86A slide into slots 18 and extend into cavity 16. As printed circuit board 80 is slid, rails 32 are slightly bent outwardly by circuit board edges 81. Tabs 34 guide circuit board 80 as is it slid. When circuit board 80 reaches contact with plate 12, protrusions 36 slip into notches 82. The protrusions 36 and notches 82 hold plate 12 to circuit board 80. Next, lock 50 is placed over rails 32. As lock 50 is pushed over rails 32, fingers 54 are displaced outwardly by bumps 38. As lock 50 is pushed further, bumps 38 engage holes 55 and fingers 54 move inwardly. Also, lip 56 now covers walls 20 and terminals 86. The lock is now installed and prevents rails 32 from bending outwardly and inadvertently releasing printed circuit board 80 from rails 32.

The printed circuit board retainer has several advantages. It eliminates the problems associated with insert molding of the terminals resulting in a simpler lower cost manufacturing operation. It allows for easier assembly of the terminals to the printed circuit board because the terminals can be attached to the printed circuit board prior to assembly with the circuit board retainer.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A printed circuit board retainer for holding a printed circuit board comprising:

a) a plate having opposing first and second surfaces;

b) a plurality of slots extending through the plate;

c) a pair of rails mounted to the second surface and extending therefrom, the printed circuit board located between the rails, a bump extending outwardly from each rail;

d) a protrusion extending from the rails, the protrusion engaging a notch in the printed circuit board as the printed circuit board is slid into the rails;

e) a plurality of terminals mounted to the printed circuit board and extending through the slots; and f) a unitary lock mounted over the rails, the lock extending across the printed circuit board and engaging the rails, the lock having a pair of fingers extending therefrom, the fingers each having a hole, the bump on the rail engaging the hole to retain the lock to the rail, the lock preventing the printed circuit board from being removed from the rails.

2. The printed circuit board retainer according to claim 1, wherein the plate is attached to a housing.

3. The printed circuit board retainer according to claim 1, wherein a plurality of walls are located between the slots to insulate the terminals.

4. The printed circuit board retainer according to claim 1, wherein the lock has a lip that extends over the walls and the terminals.

5. The printed circuit board retainer according to claim 1, wherein a connector shroud extends from the first surface.

6. The printed circuit board retainer according to claim 1, wherein the lock has a beam that extends between the fingers.

7. The printed circuit board retainer according to claim 1, wherein a tab is connected to each rail, the tab extending over the printed circuit board.

8. A printed circuit board retainer comprising:

a) a printed circuit board having a plurality of terminals mounted to the printed circuit board and extending outwardly therefrom, the printed circuit board having a pair of sides, the sides each having a notch;

b) a latch assembly, the latch assembly comprising:

b1) a plate having a first and second surface;

b2) a plurality of slots extending through the plate between the first and second surfaces;

b3) a first and second rail mounted to the second surface and extending therefrom, the slots located between the rails, the printed circuit board located between the rails;

b4) a bump extending outwardly from each rail;

b5) a protrusion extending inwardly from each rail, the protrusion engaging the notch in the printed circuit board as the printed circuit board is slid into the rails;

c) a single piece lock mounted over the rails, the lock extending across the printed circuit board and engaging the rails, the lock comprising:

c1) a beam;

c2) a pair of fingers mounted at each end of the beam and extending therefrom; and c2) a hole located in each of the fingers, the bump sliding into the hole as the lock is pressed onto the latch assembly, the lock preventing the printed circuit board from being removed from the rails.

9. The printed circuit board retainer according to claim 8, wherein a tab is connected to each rail, the tab extending over the printed circuit board, the tab guiding the printed circuit board as it is inserted.

10. The printed circuit board retainer according to claim 8, wherein the plate is attached to a housing.

11. The printed circuit board retainer according to claim 8, wherein a plurality of walls are located between the slots to insulate the terminals.

12. The printed circuit board retainer according to claim 8, wherein the lock has a lip that extends over the walls and the terminals.

13. The printed circuit board retainer according to claim 8, wherein a connector shroud extends from the first surface.

* * * * *